US008811847B2

(12) United States Patent
Aoki et al.

(10) Patent No.: US 8,811,847 B2
(45) Date of Patent: Aug. 19, 2014

(54) IMAGE FORMING APPARATUS AND POWER CONTROL DEVICE

(71) Applicants: Mikiyuki Aoki, Toyohashi (JP); Junichi Masuda, Toyokawa (JP); Taku Kimura, Toyokawa (JP); Takahiro Yokoya, Hachioji (JP)

(72) Inventors: Mikiyuki Aoki, Toyohashi (JP); Junichi Masuda, Toyokawa (JP); Taku Kimura, Toyokawa (JP); Takahiro Yokoya, Hachioji (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 13/737,060

(22) Filed: Jan. 9, 2013

(65) Prior Publication Data

US 2013/0183057 A1 Jul. 18, 2013

(30) Foreign Application Priority Data

Jan. 17, 2012 (JP) ..... 2012-006862

(51) Int. Cl.
*G03G 15/00* (2006.01)
*G03G 15/02* (2006.01)

(52) U.S. Cl.
CPC ..... *G03G 15/5004* (2013.01); *G03G 15/0283* (2013.01)
USPC ..... 399/88; 399/89

(58) Field of Classification Search
CPC ..... G03G 15/5004; G03G 15/0283; G03G 2221/166; G03G 15/80; G03G 15/0266; G03G 15/00
USPC ..... 399/88, 89, 90; 358/1.14
See application file for complete search history.

(56) References Cited

U.S. PATENT DOCUMENTS 5,376,998 A 12/1994 Suzuki
7,173,720 B2 * 2/2007 Nishizawa ..... 358/1.14
(Continued)

FOREIGN PATENT DOCUMENTS

JP 64-059267 A 3/1989
JP 64-077468 A 3/1989
(Continued)

OTHER PUBLICATIONS

Office Action (Decision to Grant a Patent) issued on Apr. 1, 2014, by the Japan Patent Office in corresponding Japanese Patent Application No. 2012-006862, and an English Translation of the Office Action. (4 pages).

*Primary Examiner* — Hoang Ngo
(74) *Attorney, Agent, or Firm* — Buchanan Ingersoll & Rooney PC

(57) ABSTRACT

An image forming apparatus that forms a color image by overlaying toner images formed on respective first, second, and third photoreceptors, comprising: first, second, and third voltage-applied members respectively facing the first, second, and third photoreceptors; a first AC power supply generating first AC voltage, and superimposing the first AC voltage on first DC voltage to generate first voltage for causing a first electric field between the first voltage-applied member and the first photoreceptor; a second AC power supply generating second AC voltage, and superimposing the second AC voltage on second DC voltage to generate second voltage for causing a second electric field between the second voltage-applied member and the second photoreceptor; and a composite circuit superimposing a composite of the first voltage and the second voltage on third DC voltage, to generate third voltage for causing a third electric field between the third voltage-applied member and the third photoreceptor.

12 Claims, 4 Drawing Sheets

(56) References Cited

U.S. PATENT DOCUMENTS

| | | | | |
|---|---|---|---|---|
| 8,213,824 | B2 * | 7/2012 | Cho et al. | 399/88 |
| 2008/0085131 | A1 | 4/2008 | Kitazawa et al. | |
| 2009/0169225 | A1 | 7/2009 | Murata et al. | |

FOREIGN PATENT DOCUMENTS

| | | | |
|---|---|---|---|
| JP | 5-197254 | A | 8/1993 |
| JP | 06-266212 | A | 9/1994 |
| JP | 2000-314996 | A | 11/2000 |
| JP | 2001-235928 | A | 8/2001 |
| JP | 2003-140526 | A | 5/2003 |
| JP | 2005-025008 | A | 1/2005 |
| JP | 2006-220955 | A | 8/2006 |
| JP | 2008-096534 | A | 4/2008 |
| JP | 2009-145456 | A | 7/2009 |
| JP | 2010-002615 | A | 1/2010 |

* cited by examiner

IMAGE FORMING APPARATUS AND POWER CONTROL DEVICE

This application is based on application No. 2012-6862 filed in Japan, the content of which is hereby in incorporate reference.

BACKGROUND OF THE INVENTION (1) Field of the Invention

The present invention relates to an image forming apparatus that forms toner images on respective three photoreceptors by an electrophotographic process, and a power control device suitably used for such an image forming apparatus.

(2) Description of the Related Art

As an image forming apparatus that forms a full-color image by an electrophotographic method, a tandem-type color printer including four image forming units for forming toner images of respective Y (yellow), M (magenta), C (cyan), and K (black) colors is known. In such a tandem-type color printer, each image forming unit includes a photoreceptor drum.

In each image forming unit, a surface of the photoreceptor drum is uniformly charged by a charging device, and the charged surface of the photoreceptor drum is irradiated with a laser light to form an electrostatic latent image. The electrostatic latent image formed on the surface of the photoreceptor drum is developed with toner of a corresponding color Y, M, C, or K by a developing device included in the image forming unit. As a result, a toner image of the corresponding color Y, M, C, or K is formed on the surface (a photosensitive layer) of the photoreceptor drum.

One known example of a method for charging the photoreceptor drum is a method of using, as the charging device, a charging roller disposed to face the photoreceptor drum, and applying a composite voltage (field-production voltage) obtained by superimposing an AC voltage on a DC voltage to the charging roller, so that discharge is caused by a potential difference between the charging roller and the photoreceptor drum.

In this case, an amplitude (a potential difference) of the AC voltage included in the composite voltage is larger than a potential of the DC voltage. By applying such a composite voltage between the charging roller and the photoreceptor drum, the entire surface of the photoreceptor drum is almost uniformly charged to have a predetermined potential.

It is also known that, when the electrostatic latent image formed on the surface (photosensitive layer) of the photoreceptor drum is developed with toner in a developing device included in each process unit, the composite voltage obtained by superimposing the AC voltage on the DC voltage is applied, as a developing bias voltage, between the photoreceptor drum and a developing roller disposed to face the photoreceptor drum. In this case, the electrostatic latent image formed on the photoreceptor drum is developed, by an electric field produced between the developing roller and the photoreceptor drum, with toner that is conveyed on a surface of the developing roller.

In both cases, it is necessary to apply, for each process unit, a composite voltage appropriate for properties of the photosensitive layer of the photoreceptor drum, toner of each color, and the like, between the photoreceptor drum and the charging roller, or between the photoreceptor drum and the developing roller.

Patent Literature 1 (Japanese Patent Application Publication No. 5-197254) discloses an image forming apparatus that sequentially forms toner images of respective Y, M, C, and K colors on a surface of a single photoreceptor drum by using four developing devices each disposed to face the photoreceptor drum in a fixed manner. In the image forming apparatus disclosed in Patent Literature 1, a single developing power control device generates composite voltages, and the generated composite voltages are sequentially output to the respective four developing devices while performing high-speed switching by an electronic switch.

With such a structure, developing bias voltages applied to the respective four developing devices for Y, M, C, and K colors are generated by a single developing power control device. Compared to a case where four developing bias voltages are generated by respective four developing power control devices, the number of components is reduced, thereby leading to cost savings.

In the image forming apparatus disclosed in Patent Literature 1, in order to sequentially form four toner images on the single photoreceptor drum, composite voltages generated by the single developing power control device are applied to the respective developing rollers included in the four developing devices at different timings.

The structure disclosed in Patent Literature 1 applied to an image forming apparatus as disclosed in Patent Literature 1 including the single photoreceptor drum, however, is not applicable to an image forming apparatus including a plurality of photoreceptor drums as in the tandem-type printer described above. For example, in the tandem-type printer described above, toner images of respective Y, M, C, and K colors are formed on the respective photoreceptor drums included in the four process units almost at the same timing. It is therefore necessary to apply composite voltages between the photoreceptor drums and the respective charging rollers, or between the photoreceptor drums and the respective developing rollers at the same timing.

Furthermore, a photosensitive property and the like vary among photoreceptor drums included in the process units and toner of different colors has different properties. It is therefore also necessary to appropriately set, for each process unit, a composite voltage to be applied between the photoreceptor drum and the charging roller, or between the photoreceptor drum and the developing roller.

The structure disclosed in Patent Literature 1 in which composite voltages generated by the single developing power control device are applied to the respective four developing rollers at different timings is therefore not applicable to an image forming apparatus typified by a tandem-type printer.

Furthermore, in the structure disclosed in Patent Literature 1, an electronic switch having a transformer and the like is necessary to apply composite voltages generated by the single developing power control device to the respective four developing rollers at different timings. Such an electronic switch has a complex structure with a large number of components, and thus, even in a structure in which a single developing power control device is provided, the cost can be increased.

In an image forming apparatus including four process units typified by a tandem-type printer, it is necessary to generate an appropriate composite voltage for each of the four process units to charge the photoreceptor drum and to develop the electrostatic latent image formed on the photoreceptor drum.

The AC voltage included in the composite voltage is normally generated by an AC voltage generation circuit having a switching element and the like. If such an AC voltage generation circuit is provided for each process unit, the number of components can increase, thereby leading to increased cost.

SUMMARY OF THE INVENTION

The present invention has been conceived in light of the above problems, and aims to provide an image forming apparatus that simplifies the structure of a power control device that generates composite voltages required for respective at least three process units, thereby leading to cost savings. The present invention also aims to provide a power control device suitably used for such an image forming apparatus.

In order to achieve the above-mentioned aims, an image forming apparatus according to one aspect of the present invention is an image forming apparatus that forms a color image by overlaying, one on top of another, toner images formed on respective first, second, and third photoreceptors by an electrophotographic process, comprising: a first voltage-applied member facing the first photoreceptor; a second voltage-applied member facing the second photoreceptor; a third voltage-applied member facing the third photoreceptor; a first AC power supply configured to generate first AC voltage, and superimpose the first AC voltage on first DC voltage to generate first field-production voltage for causing a first AC electric field between the first voltage-applied member and the first photoreceptor; a second AC power supply configured to generate second AC voltage having a same frequency as the first AC voltage, and superimpose the second AC voltage on second DC voltage to generate second field-production voltage for causing a second AC electric field between the second voltage-applied member and the second photoreceptor; and a composite circuit configured to superimpose a composite of the first field-production voltage and the second field-production voltage on third DC voltage, to generate third field-production voltage for causing a third AC electric field between the third voltage-applied member and the third photoreceptor.

A power control device according to one aspect of the present invention is a power control device that causes a first AC electric field with respect to a first voltage-applied member, a second AC electric field with respect to a second voltage-applied member, and a third AC electric field with respect to a third voltage-applied member, comprising: a first AC power supply configured to generate first AC voltage, and superimpose the first AC voltage on first DC voltage to generate first field-production voltage for causing the first AC electric field; a second AC power supply configured to generate second AC voltage having a same frequency as the first AC voltage, and superimpose the second AC voltage on second DC voltage to generate second field-production voltage for causing the second AC electric field; and a composite circuit configured to superimpose a composite of the first field-production voltage and the second field-production voltage on third DC voltage, to generate third field-production voltage for causing the third AC electric field.

BRIEF DESCRIPTION OF THE DRAWINGS

These and the other objects, advantages and features of the invention will become apparent from the following description thereof taken in conjunction with the accompanying drawings which illustrate specific embodiments of the present invention.

In the drawings.

DESCRIPTION OF THE PREFERRED EMBODIMENTS

The following describes an embodiment of an image forming apparatus according to the present invention.

<Structure of Image Forming Apparatus>

Figure 1:
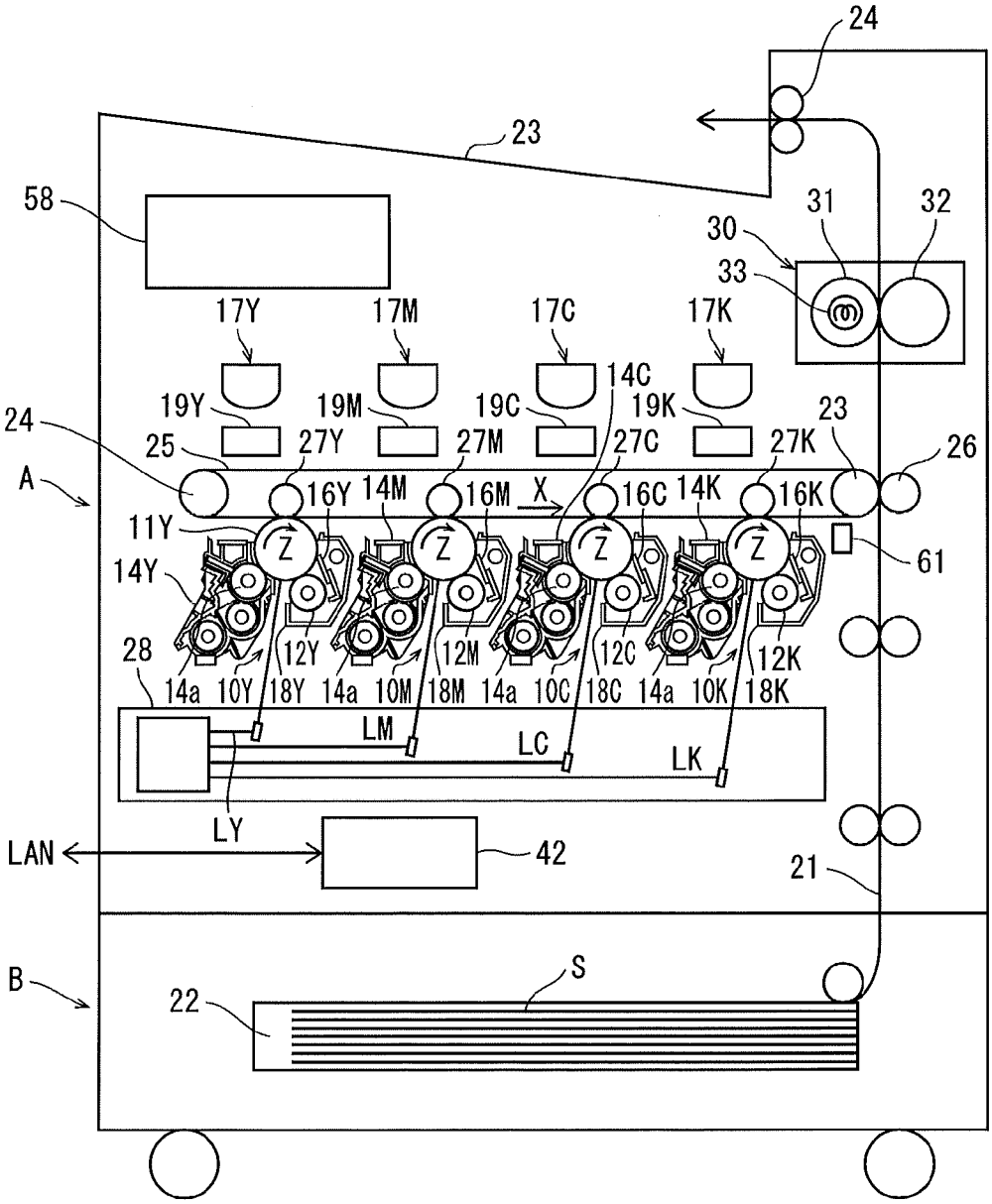
FIG. 1 is a schematic diagram illustrating the structure of an MFP device as an example of an image forming apparatus according to an embodiment of the present invention.

FIG. 1 is a schematic diagram illustrating the structure of a tandem-type color printer (hereinafter, simply referred to as a "printer") as an example of the image forming apparatus according to the embodiment of the present invention. The color printer forms a full-color or monochrome image on a recording sheet, such as a recording paper and an OHP sheet, by a well-known electrophotographic method, based on image data input from an external terminal and the like over the network (e.g. LAN).

The printer includes an image forming unit A and a paper feed unit B positioned below the image forming unit A. The paper feed unit B includes a paper feed cassette 22 that houses therein a recording sheet S. The recording sheet S housed in the paper feed cassette 22 is fed to the image forming unit A. The image forming unit A forms toner images of respective Y (yellow), M (magenta), C (cyan), and K (black) colors, and transfers and fixes the formed toner images onto the recording sheet S fed by the paper feed unit B.

The image forming unit A includes an intermediate transfer belt 25 that is horizontally disposed almost in the center of the printer. The intermediate transfer belt 25 is wound around a pair of belt conveyor rollers 23 and 24, and is rotated in a direction indicated by an arrow X by a motor not shown in the drawings.

Provided below the intermediate transfer belt 25 are process units 10Y, 10M, 10C, and 10K each removable from a main body having the image forming unit A. The process units 10Y, 10M, 10C, and 10K are disposed in the stated order along the rotational direction of the intermediate transfer belt 25.

Above the intermediate transfer belt 25, toner cartridges 17Y, 17M, 17C, and 17K, and toner supply mechanisms 19Y, 19M, 19C, and 19K are respectively provided for the process units 10Y, 10M, 10C, and 10K. The toner cartridges 17Y, 17M, 17C, and 17K house therein toner of respective Y (yellow), M (magenta), C (cyan), and K (black) colors. The toner supply mechanisms 19Y, 19M, 19C, and 19K supply toner housed in the respective toner cartridges 17Y, 17M, 17C, and 17K to the respective process units 10Y, 10M, 10C, and 10K.

The process units 10Y, 10M, 10C, and 10K respectively include photoreceptor drums 11Y, 11M, 11C, and 11K positioned below the intermediate transfer belt 25. The photoreceptor drums 11Y, 11M, 11C, and 11K are rotatably disposed to face the intermediate transfer belt 25. A photosensitive layer is provided over the entire surface of each of the photoreceptor drums 11Y, 11M, 11C, and 11K. Each of the photoreceptor drums 11Y, 11M, 11C, and 11K rotates in a direction indicated by an arrow Z.

Cleaning members 16Y, 16M, 16C, and 16K are provided downstream, in the rotational directions of the respective photoreceptor drums 11Y, 11M, 11C, and 11K, from the positions at which the respective photoreceptor drums 11Y, 11M, 11C, and 11K face the intermediate transfer belt 25, so as to face the respective photoreceptor drums 11Y, 11M, 11C, and 11K. The cleaning members 16Y, 16M, 16C, and 16K remove toner remaining on surfaces of the respective photoreceptor drums 11Y, 11M, 11C, and 11K.

Charging rollers 12Y, 12M, 12C, and 12K are provided downstream, in the rotational directions of the respective photoreceptor drums 11Y, 11M, 11C, and 11K, from the respective cleaning members 16Y, 16M, 16C, and 16K. The charging rollers 12Y, 12M, 12C, and 12K uniformly charge the respective photosensitive layers of the photoreceptor drums 11Y, 11M, 11C, and 11K so that each photosensitive layer has a predetermined potential. The charging rollers 12Y, 12M, 12C, and 12K are each voltage-applied members to which respective voltages are applied to produce electric fields between the charging rollers 12Y, 12M, 12C, and 12K and the respective photoreceptor drums 11Y, 11M, 11C, and 11K. The produced electric fields cause discharge, so that the photosensitive layers of the photoreceptor drums 11Y, 11M, 11C, and 11K are charged.

Each of the charging rollers 12Y, 12M, 12C, and 12K includes a hollow cylindrical body having an elastic layer or a high-resistance resin layer, and a metal cored bar provided inside the cylindrical body. The charging rollers 12Y, 12M, 12C, and 12K rotate while being in contact with or at a predetermined distance from the respective surfaces of the photoreceptor drums 11Y, 11M, 11C, and 11K.

In order to charge the photosensitive layers of the photoreceptor drums 11Y, 11M, 11C, and 11K so that each photosensitive layer has a predetermined potential, composite voltages, each obtained by superimposing an AC voltage on a DC voltage, are applied to the respective charging rollers 12Y, 12M, 12C, and 12K. As a result, electric fields are produced between the charging rollers 12Y, 12M, 12C, and 12K and the respective photoreceptor drums 11Y, 11M, 11C, and 11K. The produced electric fields cause discharge, so that each of the photosensitive layers of the photoreceptor drums 11Y, 11M, 11C, and 11K is charged to have a predetermined potential.

An exposure unit 28 is provided below the process units 10Y, 10M, 10C, and 10K. The exposure unit 28 shines laser lights LY, LM, LC, and LK on the respective photoreceptor drums 11Y, 11M, 11C, and 11K having been charged by the respective charging rollers 12Y, 12M, 12C, and 12K. As a result, an electrostatic latent image is formed on a photosensitive layer of each of the photoreceptor drums 11Y, 11M, 11C, and 11K.

In the process units 10Y, 10M, 10C, and 10K, developing devices 14Y, 14M, 14C, and 14K are provided downstream, in the rotational directions, from the positions at which the laser lights LY, LM, LC, and LK are shined on the respective photoreceptor drums 11Y, 11M, 11C, and 11K. The developing devices 14Y, 14M, 14C, and 14K develop electrostatic latent images formed on the respective photosensitive layers of the photoreceptor drums 11Y, 11M, 11C, and 11K using two-component developer including toner of respective Y, M, C, and K colors and carrier having magnetic properties.

The developing devices 14Y, 14M, 14C, and 14K have respective developing rollers 14*a* disposed to face the photoreceptors 11Y, 11M, 11C, and 11K. When electrostatic latent images formed on the respective photoreceptors 11Y, 11M, 11C, and 11K are developed using toner of respective Y, M, C, and K colors, composite voltages, each obtained by superimposing an AC voltage on a DC voltage, are applied to the respective developing rollers 14*a*. Each of the developing rollers 14*a* is therefore also a voltage-applied member.

By applying composite voltages to the respective developing rollers 14*a*, electric fields are produced between the developing rollers 14*a* and the respective photosensitive layers of the photoreceptor drums 11Y, 11M, 11C, and 11K. By the produced electric fields, electrostatic latent images formed on the respective photosensitive layers are developed using toner of respective Y, M, C, and K colors.

Primary transfer rollers 27Y, 27M, 27C, and 27K are provided above the respective process units 10Y, 10M, 10C, and 10K so as to face the respective photoreceptor drums 11Y, 11M, 11C, and 11K across the intermediate transfer belt 25. The primary transfer rollers 27Y, 27M, 27C, and 27K are each attached to the main body. By applying transfer bias voltages to the respective primary transfer rollers 27Y, 27M, 27C, and 27K, electric fields are produced between the primary transfer rollers 27Y, 27M, 27C, and 27K and the respective photoreceptor drums 11Y, 11M, 11C, and 11K facing the primary transfer rollers 27Y, 27M, 27C, and 27K.

Toner images formed on the respective photoreceptor drums 11Y, 11M, 11C, and 11K are primary-transferred onto the intermediate transfer belt 25 by the action of the electric fields produced between the primary transfer rollers 27Y, 27M, 27C, and 27K and the respective photoreceptor drums 11Y, 11M, 11C, and 11K.

When a full-color image is formed, image forming operations of the process units 10Y, 10M, 10C, and 10K are performed at different timings, so that toner images formed on the respective photoreceptor drums 11Y, 11M, 11C, and 11K are multi-transferred onto the same position on the intermediate transfer belt 25.

On the other hand, when a monochrome image is formed, only one selected process unit (e.g. the process unit 10K for toner of the K color) forms a toner image on a photoreceptor drum of the process unit, and the formed toner image is transferred onto a predetermined region on the intermediate transfer belt 25 by a primary transfer roller disposed to face the process unit.

After toner images are transferred, toner residues on the surfaces of the photoreceptor drums 11Y, 11M, 11C, and 11K are removed by the respective cleaning members 16Y, 16M, 16C, and 16K.

The intermediate transfer belt 25 rotates to convey the transferred toner image to an edge portion (a right edge portion in FIG. 1) of the intermediate transfer belt 25 at which the intermediate transfer belt 25 is wound around the belt conveyor roller 23. The belt conveyor roller 23 faces a secondary transfer roller 26 across the intermediate transfer belt 25. The secondary transfer roller 26 is pressed against the intermediate transfer belt 25. A transfer nip is formed between the secondary transfer roller 26 and the intermediate transfer belt 25.

By applying a transfer bias voltage to the secondary transfer roller 26, an electric field is produced between the secondary transfer roller 26 and the intermediate transfer belt 25.

The recording sheet S fed from the paper feed cassette 22 included in the paper feed unit B to a sheet conveyance path 21 is conveyed to the transfer nip formed between the secondary transfer roller 26 and the intermediate transfer belt 25. The toner image transferred onto the intermediate transfer belt 25 is secondary-transferred onto the recording sheet S conveyed along the sheet conveyance path 21 by the action of the electric field produced between the secondary transfer roller 26 and the intermediate transfer belt 25.

The recording sheet S passing though the transfer nip is conveyed to a fixing device 30 disposed above the secondary transfer roller 26. The fixing device 30 includes a heat roller 31 and a pressure roller 32. The heat roller 31 and the pressure roller 32 are pressed against each other so that a fixing nip is formed therebetween. A heater lamp 33 is disposed along an axis of the heat roller 31. The heater lamp 33 heats the heat roller 31.

In the fixing device 30, by applying heat and pressure to an unfixed toner image formed on the recording sheet S when the recording sheet S passes through the fixing nip formed between the heat roller 31 and the pressure roller 32, the unfixed toner image is fixed onto the recording sheet S. The recording sheet S onto which the toner image has been fixed is ejected by ejection rollers 24 onto a receiving tray 23 disposed above the toner cartridges 17Y, 17M, 17C, and 17K.

<Power Control Device>

Figure 2:
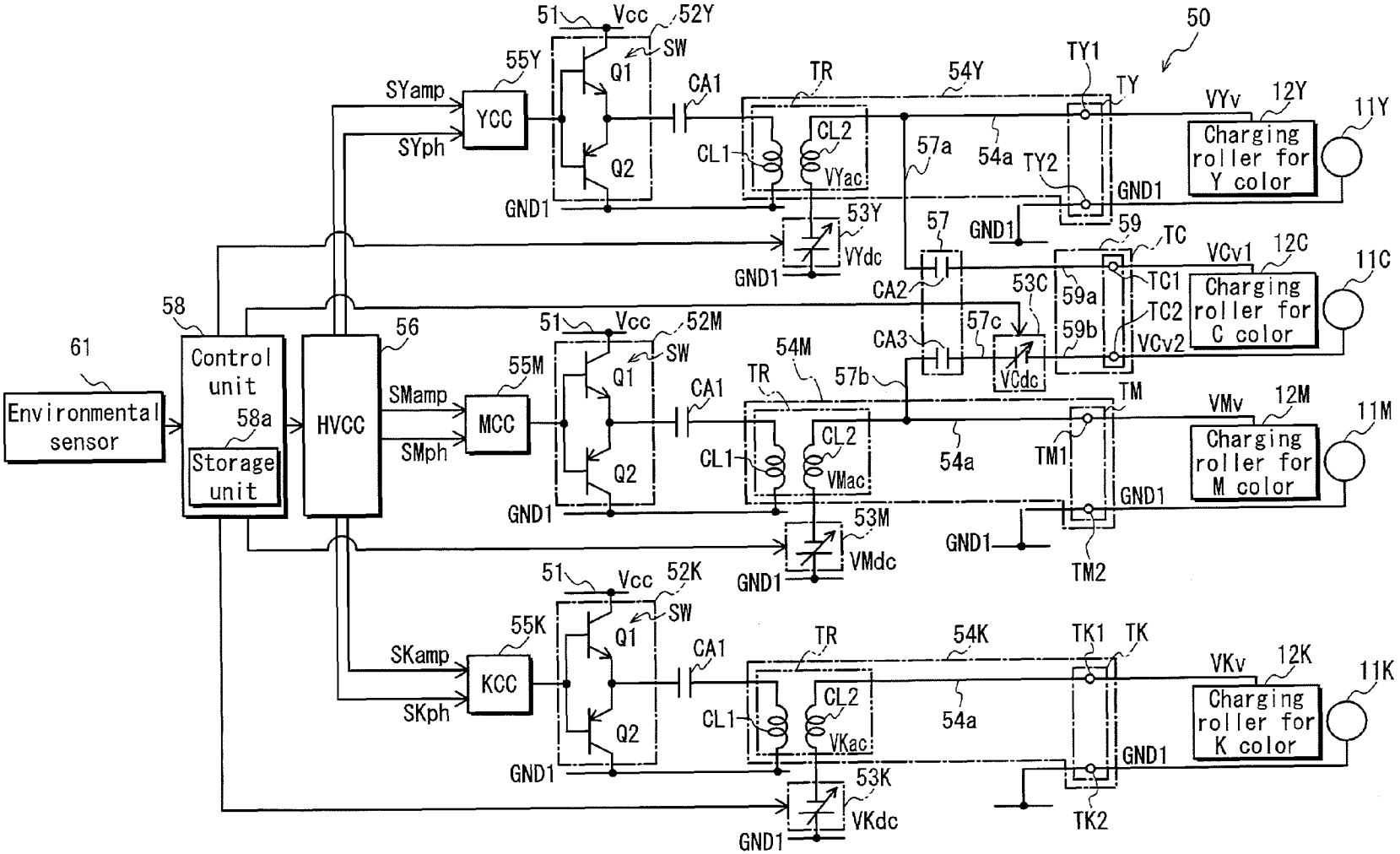
FIG. 2 is a block diagram showing the structure of a charging power control device that applies composite voltages to respective charging rollers included in process units of the MFP illustrated in FIG. 1.

FIG. 2 is a block diagram showing the structure of a charging power control device 50. The charging power control device 50 produces predetermined AC electric fields between the charging rollers 12Y, 12M, 12C, and 12K and the respective photoreceptor drums 11Y, 11M, 11C, and 11K provided in the respective process units 10Y, 10M, 10C, and 10K.

The charging power control device 50 generates composite voltages (AC voltages for causing electric fields) VYv, VMv, VCv, and VKv, each obtained by superimposing an AC voltage on a DC voltage, and outputs the generated composite voltages VYv, VMv, VCv, and VKv from output terminal units TY, TC, TM, and TK, respectively.

The output terminal units TY, TC, TM, and TK respectively include first and second terminals TY1 and TY2, first and second terminals TC1 and TC2, first and second terminals TM1 and TM2, and first and second terminals TK1 and TK2. The first terminals TY1, TC1, TM1, and TK1 are connected to the respective cored bars of the charging rollers 12Y, 12C, 12M, and 12K. The second terminals TY2, TC2, TM2, and TK2 are respectively connected to the photoreceptor drums 11Y, 11M, 11C, and 11K.

The first terminals TY1, TM1, and TK1 respectively included in the output terminal units TY, TM, and TK apply the composite voltages (field-production voltages) VYv, VMv, and VKv to the respective cored bars of the charging rollers 12Y, 12M, and 12K. The second terminals TY2, TM2, and TK2 are connected to respective grounds GND1 so that each of the photoreceptor drums 11Y, 11M, and 11K respectively connected to the second terminals TY2, TM2, and TK2 has a reference voltage.

Due to differences between the composite voltages VYv, VMv, and VKv, and the respective grounds GND1, AC voltages are applied to respective circuit sections (corresponding to series circuits in each of which a resistor and a capacitor are connected in series) formed from the charging rollers 12Y, 12M, and 12K and the respective photoreceptor drums 11Y, 11M, and 11K. Discharge is caused by the electric fields produced between the charging rollers 12Y, 12M, and 12K and the respective photoreceptor drums 11Y, 11M and 11K. As a result, the photoreceptor drums 11Y, 11M, and 11K are charged.

A first oscillation voltage VCv1 included in the composite voltage VCv is supplied to the first terminal TC1 included in the output terminal unit TC, and thus the first oscillation voltage VCv1 is applied to the cored bar of the charging roller 12C connected to the first terminal TC1. A second oscillation voltage VCv2 included in the composite voltage VCv is supplied to the second terminal TC2, and thus the second oscillation voltage VCv2 is applied to the photoreceptor drum 11C connected to the second terminal TC2.

An AC voltage is applied to a circuit section (corresponding to a series circuit in which a resistor and a capacitor are connected in series) formed from the charging roller 12C and the photoreceptor drum 11C. Discharge is caused by an electric field produced between the charging roller 12C and the photoreceptor drum 11C. As a result, the photoreceptor drum 11C is charged.

The charging power control device 50 is provided with three AC power generators 52Y, 52M, and 52K each connected between the ground GND1 and a power line 51 to which a DC current with a predetermined high voltage is supplied. The AC power generators 52Y, 52M, and 52K are connected in parallel to one another. The AC power generators 52Y, 52M, and 52K are respectively controlled by an AC power control circuit for the Y color (YCC) 55Y, an AC power control circuit for the M color (MCC) 55M, and an AC power control circuit for the K color (KCC) 55K. The AC power generators 52Y, 52M, and 52K each output a sinusoidal AC power having a common frequency, and a predetermined amplitude (a peak-to-peak voltage) and a predetermined phase set for each of the AC power generators 52Y, 52M, and 52K.

The AC power generators 52Y, 52M, and 52K have similar structures and each have a switching circuit SW.

Each switching circuit SW has an NPN transistor Q1 and a PNP transistor Q2. An emitter of the NPN transistor Q1 and an emitter of the PNP transistor Q2 are connected to each other. An output terminal of the switching circuit SW is at the connection between the emitters.

A collector of the NPN transistor Q1 is connected to the power line 51, and a collector of the PNP transistor Q2 is connected to the ground GND1. A base of the NPN transistor Q1 and a base of the PNP transistor Q2 are connected to each other. A control terminal of the switching circuit SW is at the connection between the bases. The control terminal of the switching circuit SW is provided with a control signal output from the AC power control circuit 55Y.

The switching circuit SW of the AC power generator 52Y is switched on and off at a predetermined timing by the control signal output from the AC power control circuit 55Y. As a result, a sinusoidally-varying AC voltage is output from the output terminal (an output terminal of the AC power generator 52Y) of the switching circuit SW.

The AC power control circuit 55Y outputs, to the control terminal of the switching circuit SW, a control signal for controlling a timing at which the NPN transistor Q1 and the PNP transistor Q2 included in the switching circuit SW are each switched on, based on an amplitude control signal SYamp and a phase control signal SYph output from a high-voltage power control circuit 56. As a result, the switching circuit SW outputs a sinusoidally-varying AC voltage controlled to have a predetermined amplitude and a predetermined phase.

Similarly to the AC power generator 52Y, the control terminal of the switching circuit SW of the AC power generator 52M is provided with a control signal output from the AC power control circuit 55M, and each of the NPN transistor Q1 and the PNP transistor Q2 is switched on and off at a predetermined timing by the output control signal. The control terminal of the switching circuit SW of the AC power generator 52K is also provided with a control signal output from the AC power control circuit 55K, and each of the NPN transistor Q1 and the PNP transistor Q2 is switched on and off at a predetermined timing by the output control signal.

The AC power control circuit 55M outputs, to the control terminal of the switching circuit SW, a control signal for controlling a timing at which the NPN transistor Q1 and the PNP transistor Q2 included in the switching circuit SW are each switched on, based on an amplitude control signal SMamp and a phase control signal SMph output from a high-voltage power control circuit 56. The AC power control circuit 55K outputs, to the control terminal of the switching circuit SW, a control signal for controlling a timing at which the NPN transistor Q1 and the PNP transistor Q2 included in the switching circuit SW are each switched on, based on an amplitude control signal SKamp and a phase control signal SKph output from a high-voltage power control circuit 56. As a result, the switching circuit SW (of each of the AC power generators 52M and 52K) outputs a sinusoidally-varying AC voltage controlled to have a predetermined voltage and a predetermined phase.

The high-voltage power control circuit 56 is instructed by a control unit 58 for controlling the MFP device as a whole to generate the amplitude control signals SYamp, SMamp, and SKamp, and the phase control signals SYph, SMph, and SKph.

The control unit 58 includes a storage unit 58*a* in which various types of information are stored. The control unit 58 is provided with results of detection performed by an environmental sensor 61 (see FIGS. 1 and 2) that detects environmental temperature and humidity of the intermediate transfer belt 25 inside the MFP device.

An AC voltage output from the AC power generator 52Y (an AC voltage output from the switching circuit SW) is provided to a voltage composite circuit 54Y via a first capacitor (condenser) CA1 being a DC cut-off filter. The voltage composite circuit 54Y includes an AC transformer TR that includes a first coil (winding) CL1 and a second coil (winding) CL2. An AC voltage which is output from the switching circuit SW and whose DC component is cut off by the first capacitor CA1 is applied to one end of the first coil CL1, and the ground GND1 is connected to the other end of the first coil CL1.

One end of the second coil CL2 included in the AC transformer TR is connected in series to a DC power supply 53Y connected to the ground GND1. The DC power supply 53Y generates a negative DC voltage with respect to the ground GND1, and applies the generated negative DC voltage to the second coil CL2. A high-voltage side output line 54*a* is connected to the other end of the second coil (winding) CL2. The high-voltage side output line 54*a* is connected to the first terminal TY1 included in the output terminal unit TY described above.

An AC voltage VYac obtained by boosting an AC voltage to be supplied to the first coil CL1 is generated by the second coil CL2 included in the AC transformer TR. The AC voltage VYac is superimposed on the negative DC voltage VYdc output from the DC power supply 53Y to generate the composite voltage VYv. The generated composite voltage VYv is output to the high-voltage side output line 54*a* and applied to the first terminal TY1 included in the output terminal unit TY.

The composite voltage VYv is an oscillation voltage whose center of oscillation is the negative DC voltage VYdc and which has a waveform identical to the AC voltage VYac. An amplitude (a peak-to-peak voltage) of the composite voltage VYv is represented by VYpp. When the composite voltage VYv as described above is applied to the charging roller 12Y connected to the first terminal TY1, a predetermined electric field is produced between the charging roller 12Y and the photoreceptor drum 11Y connected to the ground GND1, thereby causing discharge. As a result, the entire surface of the photosensitive layer of the photoreceptor drum 11Y is almost uniformly charged to have a predetermined negative potential.

The AC voltage VYac included in the composite voltage VYv is an AC voltage obtained by boosting an AC voltage output from the AC power generator 52Y at a constant rate, using the AC transformer TR. The amplitude VYpp and a phase of the AC voltage VYac are controlled to be predetermined values by the control signal output from the AC power control circuit 55Y. The DC power supply 53Y is a variable output-type power supply capable of adjusting the output DC voltage VYdc.

As described above, the AC power generator 52Y, the DC power supply 53Y, and the voltage composite circuit 54Y constitute an AC power supply for generating the composite voltage (field-production voltage) VYv.

AC voltages output from the other AC power generators 52M and 52K (AC voltages output from the switching circuits SW) are respectively provided to the voltage composite circuits 54M and 54K via the respective first capacitors (condensers) CA1 each being the DC cut-off filter.

Each of the voltage composite circuits 54M and 54K has a similar structure to the voltage composite circuit 54Y, and has the AC transformer TR. An AC voltage which is output from the switching circuit SW and whose DC component is cut off by the first capacitor CA1 is applied to the first coil CL1 included in the AC transformer TR. AC voltages VMac and VKac generated by the respective second coils CL2 included in the AC transformers TR are respectively superimposed on the negative DC voltages VMdc and VKdc respectively output from the DC power supplies 53M and 53K, and output to the high-voltage side output lines 54*a* connected to the second coils CL2 as the composite voltages (field-production voltages) VMv and VKv.

The composite voltages VMv and VKv are also oscillation voltages whose centers of oscillation are respectively the negative DC voltages VMdc and VKdc, and which respectively have waveforms identical to the AC voltages VMac and VKac. Amplitudes (peak-to-peak voltages) of the composite voltages VMv and VKv are respectively represented by VMpp and VKpp.

The generated composite voltages VMv and VKv are respectively applied to the first terminals TM1 and TK1 included in the output terminal units TM and TK via the high-voltage side output lines 54*a*.

The composite voltages VMv and VKv are respectively applied to the charging rollers 12M and 12K respectively connected to the first terminals TM1 and TK1 included in the output terminal units TM and TK. As a result, predetermined electric fields are produced between the charging roller 12M and the photoreceptor drum 11M connected to the ground GND1, and between the charging roller 12K and the photoreceptor drum 11K connected to the ground GND1, thereby causing discharge. The entire surfaces of the photosensitive layers of the photoreceptor drums 11M and 11K are almost uniformly charged to have predetermined negative potentials. As described above, the AC power generator 52M, the DC power supply 53M, and the voltage composite circuit 54M constitute an AC power supply for generating the composite voltage VMv, and the AC power generator 52K, the DC power supply 53K, and the voltage composite circuit 54K constitute an AC power supply for generating the composite voltage VKv.

The AC voltage VMac included in the composite voltage VMv is also an AC voltage obtained by boosting an AC voltage output from the AC power generator 52M at a constant rate, using the AC transformer TR. The amplitude VMpp and a phase of the AC voltage VMac are therefore controlled to be predetermined values by the control signal output from the AC power control circuit 55M.

In this case, the phase of the AC voltage VMac is controlled to have a predetermined phase difference from the phase of the AC voltage VYac. The phase difference is determined based on the amplitudes VYpp, VMpp, and VCpp of the respective AC voltages VYac, VMac, and VCac.

The AC voltage VKac included in the composite voltage VKv is also an AC voltage obtained by boosting an AC voltage output from the AC power generator 52K at a constant rate, using the AC transformer TR. The amplitude VKpp and a phase of the AC voltage VKac are therefore controlled to be predetermined values by the control signal output from the AC power control circuit 55K.

The DC power supplies 53M and 53K are variable output-type power supplies capable of adjusting the output DC voltages VMdc and VKdc, respectively.

The AC power generator 52M, the DC power supply 53M, and the voltage composite circuit 54M constitute an AC power supply for the M color, and the AC power generator 52K, the DC power supply 53K, and the voltage composite circuit 54K constitute an AC power supply for the K color.

First differential voltage input-side wiring 57*a* branches from the high-voltage side output line 54*a* connected to the second coil CL2 included in the AC transformer TR provided to the voltage composite circuit 54Y. A second capacitor (condenser) CA2 being the DC cut-off filter is connected to the first differential voltage input-side wiring 57*a*. The second capacitor CA2 constitutes a differential voltage generation circuit 57 that generates the AC voltage VCac included in the composite voltage VCv.

The composite voltage VYv generated by the voltage composite circuit 54Y is supplied to the second capacitor CA2 through the first differential voltage input-side wiring 57*a* branching from the high-voltage side output line 54*a*. The second capacitor CA2 cuts off the DC component of the composite voltage VYv. First output-side wiring 59*a* for the C color is connected to an output side of the second capacitor CA2. The AC voltage obtained by cutting off the DC component of the composite voltage VYv is output to the first output-side wiring 59*a*. The AC voltage output to the first output-side wiring 59*a* therefore corresponds to the AC voltage VYac.

The first output-side wiring 59*a* is connected to the first terminal TC1 included in the output terminal unit TC. The AC voltage supplied through the first output-side wiring 59*a* (corresponding to the AC voltage VYac) is output to the first terminal TC1 as the first composite voltage VCv1. The first composite voltage VCv1 is applied to the charging roller 12C connected to the first terminal TC1.

Similarly, second differential voltage input-side wiring 57*b* branches from the high-voltage side output line 54*a* connected to the second coil CL2 included in the AC transformer TR provided to the voltage composite circuit 54M. A third capacitor (condenser) CA3 being the DC cut-off filter is connected to the second differential voltage input-side wiring 57*b*. The third capacitor CA3 constitutes, along with the second capacitor CA2, the differential voltage generation circuit 57 that generates the AC voltage VCac included in the composite voltage VCv.

The composite voltage VMv generated by the voltage composite circuit 54M is supplied to the third capacitor CA3, which constitutes the differential voltage generation circuit 57, through the second differential voltage input-side wiring 57*b* branching from the high-voltage side output line 54*a*. The third capacitor CA3 cuts off the DC component of the composite voltage VMv, and outputs it to differential voltage output-side wiring 57*c*. The AC voltage output to the differential voltage output-side wiring 57*c* therefore corresponds to the AC voltage VMac.

A DC power supply 53C is connected in series to the differential voltage output-side wiring 57*c* connected to the third capacitor CA3. The DC power supply 53C superimposes a negative DC voltage VCdc generated by the DC power supply 53C on the AC voltage output from the third capacitor CA3 to the differential voltage output-side wiring 57*c* (corresponding to the AC voltage VMac), and outputs it to second output-side wiring 59*b* for the C color.

The second output-side wiring 59*b* is connected to the second terminal TC2 included in the output terminal unit TC. The second composite voltage VCv2 obtained by superimposing the DC voltage VCdc on the AC voltage supplied from the differential voltage output-side wiring 57*c* (corresponding to the AC voltage VMac) is output to the second terminal TC2. The second composite voltage VCv2 is applied to the photoreceptor drum 11Y connected to the second terminal TC2.

By respectively applying the first composite voltage VCv1 and the second composite voltage VCv2 to the charging roller 12C connected to the first output-side wiring 59*a* and the photoreceptor drum 11C connected to the second output-side wiring 59*b* as described above, the composite voltage (an oscillation voltage for causing an electric field) VCv, which is a voltage difference between the first composite voltage VCv1 and the second composite voltage VCv2, is applied between the charging roller 12C and the photoreceptor drum 11C.

The composite voltage VCv applied between the charging roller 12C and the photoreceptor drum 11C is obtained by superimposing, on the negative DC voltage VCdc, the sinusoidally-varying AC voltage that corresponds to the difference between the first composite voltage VCv1 (=the AC voltage VYac) and the second composite voltage VCv2 (=the AC voltage VMac). The amplitude VCpp of the AC voltage VCac therefore corresponds to the difference between the amplitude VYpp of the AC voltage VYac and the amplitude VMpp of the AC voltage VMac.

As described above, the first output-side wiring 59*a* and the second output-side wiring 59*b* constitute the voltage composite circuit 59 that generates the composite voltage VCv applied between the charging roller 12C and the photoreceptor drum 11C.

Since the AC voltage VYac is equal to the AC voltage VMac in frequency, and the AC voltage VCac corresponds to the difference between the AC voltage VYac and the AC voltage VMac, the amplitude VCpp (a peak-to-peak voltage) of the AC voltage VCac corresponds to the difference between the amplitude VYpp of the AC power generator 52Y and the amplitude VMpp of the AC power generator 52M. Therefore, if the amplitude VYpp of the AC voltage VYac and the amplitude VMpp of the AC voltage VMac are each constant, the amplitude VCpp of the AC voltage VCac is made to be a predetermined value by controlling the AC voltages VYac and VMac respectively generated by the AC power generators 52Y and 52M to have a predetermined phase difference.

The amplitudes VYpp, VMpp, and VCpp of the respective AC voltages VYac, VMac, and VCac are set based on the photosensitive properties and the like of the photoreceptor drums 11Y, 11M, and 11K, respectively. Therefore, when the amplitudes VYpp and VMpp of the respective AC voltages VYac and VMac, which are equal in frequency, are set to predetermined values, the phase difference between the AC voltages VYac and VMac is set so that the amplitude VCpp of the AC voltage VCac is a predetermined value.

The composite voltage VKv is generated independently from the composite voltages VYv, VMv, and VCv. The AC power generator 52K is therefore controlled by the AC power control circuit 55K so that the AC voltage VKac output from the AC power generator 52K have a predetermined amplitude and a predetermined phase set in advance.

The following describes relationships among the amplitudes VYpp, VMpp, and VCpp and phases of the respective AC voltages VYac, VMac, and VCac. Since the AC voltage VCac corresponds to the difference between the AC voltage VYac and the AC voltage VMac, the AC voltage VCac corresponds to a composite of the AC voltage VYac and an AC voltage which is 180° out of phase with the AC voltage VMac (hereinafter, referred to as a turnover AC voltage #VMac).

Figure 3:
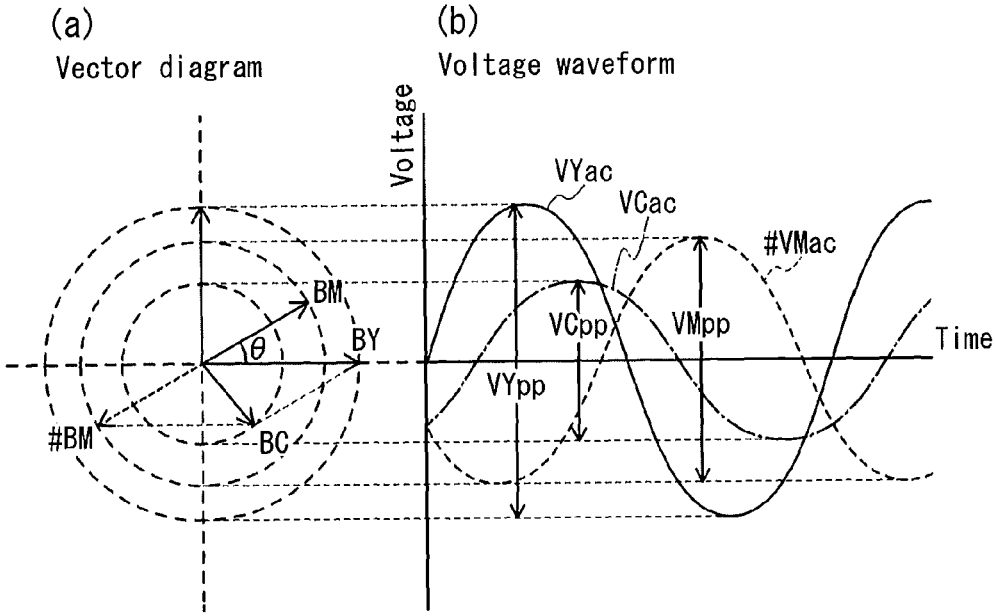
FIG. 3(*a*) is a vector diagram showing relationships among amplitudes and phases of AC voltages included in composite voltages for respective Y, C, and M colors, and FIG. 3(*b*) is a graph showing AC voltages included in composite voltages for respective Y, C, and M colors.

FIG. 3(*a*) is a vector diagram showing relationships among the amplitudes VYpp, VMpp, and VCpp and phases of the respective AC voltages VYac, VMac, and VCac. FIG. 3(*b*) shows sinusoidal waveforms of the AC voltages VYac and VCac, and the turnover AC voltage #VMac.

In FIG. 3(*b*), the AC voltages VCac and VYac, and the turnover AC voltage #VMac are respectively shown by an alternate long and short dash line, a solid line, and a broken line.

As shown in FIG. 3(*a*), a vector BM of the AC voltage VMac has a predetermined phase difference θ from a vector BY of the AC voltage VYac. As described above, since the AC voltage VCac is obtained by combining the AC voltage VYac with the turnover AC voltage #VMac, a vector BC of the AC voltage VCac is obtained by combining the vector BY of the AC voltage VYac with a vector of the turnover AC voltage #VMac, which is 180° out of phase with the vector BM of the AC voltage VMac (hereinafter, referred to as a turnover vector #BM).

The amplitudes VYpp, VMpp, and VCpp of the respective AC voltages VYac, VMac, and VCac are twice the lengths of the vectors BY, BM, and BC, respectively (When the lengths of the vectors BY, BM, and BC are respectively represented by [BY], [BM], and [BC], relations VYpp=2[BY], VMpp=2[BM], and VCpp=2[BC] are satisfied). The length of the turnover vector #BM is equal to the length [BM] of the vector BM.

In this case, the lengths of the vectors BY, BM, and BC, and the phase difference θ between the vectors BY and BM satisfy the relationship shown in the following equation (1).

$$[BC]=([BM]^2+[BY]^2-2\times[BY]\times[BM]\times\cos\theta)^{1/2} \quad (1)$$

As described above, when the length [BY] of the vector BY and the length [BM] of the vector BM are each constant, the length [BC] of the vector BC is uniquely determined from the phase difference θ between the vectors BY and BM.

The AC voltage VCac having the amplitude VCpp is therefore generated based on the amplitude VYpp (=2×[BY]) of the AC voltage VYac, the amplitude VMpp (=2×[BM]) of the AC voltage VMac, and the phase difference (θ) between the AC voltage VYac and the AC voltage VMac.

The AC voltages VYac, VMac, VKac each having a preset amplitude and a preset phase are respectively output from the AC power generators 52Y, 52M, and 52K controlled by the respective AC power control circuits 55Y, 55M, and 55K. The output AC voltages VYac, VMac, and VKac are respectively superimposed on the DC voltages VYdc, VMdc, and VKdc to respectively generate the composite voltages (field-production voltages) VYv, VMv, and VKv.

Also, the AC voltage VCac is generated based on the difference between the AC voltage VYac output from the AC power generator 52Y and the AC voltage VMac output from the AC power generator 52M. The generated AC voltage VCac is superimposed on the DC voltage VCdc to generate the composite voltage (for causing an electric field) VCv.

By respectively applying the composite voltages VYv, VMv, and VKv to the charging rollers 12Y, 12M, and 12K, electric fields are produced due to voltage differences (corresponding to the composite voltages VYv, VMv, and VKv) between the charging rollers 12Y, 12M, and 12K and the respective photoreceptor drums 11Y, 11M, and 11K connected to the respective grounds GND1, thereby causing discharge. Similarly, by respectively applying the first composite voltage VCv1 and the second composite voltage VCv2 to the charging roller 12C and the photoreceptor drum 11C, an electric field is produced due to a voltage difference (corresponding to VCv1−VCv2) between the charging roller 12C and the photoreceptor drum 11C, thereby causing discharge. As a result, each of the photosensitive layers of the photoreceptor drums 11Y, 11M, 11C, and 11K is charged to have a predetermined potential.

For example, the composite voltage VKv to be applied to the charging roller 12K is obtained by superimposing the sinusoidal AC voltage VKac having a frequency of 2.0 kHz and an amplitude of VKpp=1.5 kV on the DC voltage Vkdc of −700V.

Charge potentials of the photosensitive layers of the photoreceptor drums 11Y, 11M, 11C, and 11K are respectively determined by the DC voltages VYdc, VMdc, VCdc, and VKdc included in the respective composite voltages VYv, VMv, VCv, and VKv.

The charge potentials of the photosensitive layers of the photoreceptor drums 11Y, 11M, 11C, and 11K vary depending on environmental conditions (temperature and humidity) of the photosensitive layers. The DC voltages VYdc, VMdc, VCdc, and VKdc that determine the charge potentials of the respective photosensitive layers are therefore corrected based on the ambient temperature and humidity of the respective photosensitive layers.

Since the charge potentials of the photosensitive layers of the photoreceptor drums 11Y, 11M, 11C, and 11K are changed by degradation of the photosensitive layers and the like, the DC voltages VYdc, VMdc, VCdc, and VKdc are corrected each time the photosensitive layers are degraded, i.e. the respective process units 10Y, 10M, 10C, and 10K complete printing of a preset number of copies.

Furthermore, the AC voltages VYac, VMac, VCac, and VKac respectively included in the composite voltages VYv, VMv, VCv, and VKv are respectively superimposed on the DC voltages VYdc, VMdc, VCdc, and VKdc so that the entire surfaces of the photosensitive layers of the photoreceptor drums 11Y, 11M, 11C, and 11K are uniformly charged.

When each of the amplitudes VYpp, VMpp, VCpp, and VKpp of the respective AC voltages VYac, VMac, VCac, and VKac is extremely large, degradation of a corresponding photosensitive layer, adherence of corona products to the photosensitive layer, and the like can occur. On the other hand, when each of the amplitudes VYpp, VMpp, VCpp, and VKpp is small, an entire surface of a corresponding photosensitive layer cannot be uniformly charged. This can lead to uneven formation of a toner image on the photosensitive layer.

The amplitudes VYpp, VMpp, VCpp, and VKpp of the respective AC voltages VYac, VMac, VCac, and VKac are therefore also corrected based on the ambient temperature and humidity of the respective photosensitive layers.

The amplitudes VYpp, VMpp, VCpp, and VKpp of the respective AC voltages are corrected each time the photosensitive layers are degraded, i.e. the respective process units 10Y, 10M, 10C, and 10K complete printing of a preset number of copies.

When it is necessary to correct the amplitudes VYpp, VMpp, and VCpp of the respective AC voltages VYac, VMac, and VCac, control over the AC power control circuits 55Y and 55M is performed by the high-voltage power control circuit 56. When it is necessary to correct the amplitude VKpp of the AC voltage VKac, control over the AC power control circuit 55K is performed by the high-voltage power control circuit 56.

Correction values of the DC voltages VYdc, VMdc, VCdc, and VKdc respectively included in the composite voltages VYv, VMv, VCv, and VKv are preset based on the ambient temperature and humidity of the intermediate transfer belt 25 and the number of copies printed by each of the process units 10Y, 10M, 10C, and 10K, and the preset correction values are stored in the storage unit 58*a* included in the control unit 58 as a table.

In addition, correction values of the amplitudes VYpp, VMpp, VCpp, and VKpp of the respective AC voltages VYac, VMac, VCac, and VKac are preset based on the ambient temperature and humidity of the intermediate transfer belt 25 and the number of copies printed by each of the process units 10Y, 10M, 10C, and 10K, and the preset correction values are stored in the storage unit 58*a* as a table.

Each time the number of copies printed by each of the process units 10Y, 10M, 10C, and 10K reaches a predetermined value, the control unit 58 controls the high-voltage power control circuit 56 so that the DC voltages VYdc, VMdc, VCdc, and VKdc respectively output from the DC power supplies 53Y, 53M, 53C, and 53K become the correction values stored in the storage unit 58*a* included in the control unit 58.

In this case, the correction values of the DC voltages when the number of printed copies reaches the predetermined value are stored in the storage unit 58*a* included in the control unit 58 as reference DC voltage values. Thereafter, the reference DC voltage values stored in the storage unit 58*a* are corrected based on the results of detection performed by the environmental sensor 61 until the number of copies printed by each of the process units 10Y, 10M, 10C, and 10K reaches a newly-set predetermined value.

The control unit 58 controls the four DC power supplies 53Y, 53M, 53C, and 53K based on the results of detection performed by the environmental sensor 61 so that the DC voltages (reference DC voltage values) VYdc, VMdc, VCdc, and VKdc respectively output from the DC power supplies 53Y, 53M, 53C, and 53K become the correction values stored in the storage unit 58*a* included in the control unit 58.

Similarly, each time the number of copies printed by each of the process units 10Y, 10M, 10C, and 10K reaches the predetermined value, the control unit 58 controls the high-voltage power control circuit 56 so that the amplitudes VYpp, VMpp, VCpp, and VKpp of the respective four AC voltages VYac, VMac, VCac, and VKac become the correction values stored in the storage unit 58*a* included in the control unit 58.

In this case, the correction values of the amplitudes VYpp, VMpp, VCpp, and VKpp of the respective AC voltages VYac, VMac, VCac, and VKac when the number of printed copies reaches the predetermined value are stored in the storage unit 58*a* included in the control unit 58 as reference amplitude values. Thereafter, the stored reference amplitude values are corrected based on the results of detection performed by the environmental sensor 61 until the number of copies printed by each of the process units 10Y, 10M, 10C, and 10K reaches a newly-set predetermined value.

The control unit 58 controls the high-voltage power control circuit 56 based on the results of detection performed by the environmental sensor 61 so that the amplitudes VYpp, VMpp, VCpp, and VKpp of the respective four AC voltages VYac, VMac, VCac, and VKac become the correction values stored in the storage unit 58*a* included in the control unit 58.

In a case where either the amplitude VYpp of the AC voltage VYac or the amplitude VMpp of the AC voltage VMac is corrected, the amplitude VCpp of the AC voltage VCac is changed by the correction. For this reason, even if it is unnecessary to correct the amplitude VCpp of the AC voltage VCac, the phase difference θ between the AC voltages VYac and VMac is required to be changed to set the amplitude VCpp of the AC voltage VCac to a value not to be corrected.

Since the amplitude VCpp of the AC voltage VCac is determined based on the phase difference θ between the AC voltages VYac and VMac, when the amplitude VCpp of the AC voltage VCac is corrected, the phase difference θ between the AC voltages VYac and VMac is required to be changed even if it is unnecessary to change the amplitudes VYpp and VMpp of the respective AC voltages VYac and VMac.

In a case where any of the amplitudes VYpp, VMpp, and VCpp is corrected, the control unit 58 controls the high-voltage power control circuit 56 so that the AC voltages VYac and VMac each having been corrected to have a predetermined amplitude and a predetermined phase are respectively output from the AC power generators 52Y and 52M. The high-voltage power control circuit 56 respectively outputs, to the AC power control circuits 55Y and 55M, predetermined amplitude control signals SYamp and SMamp, and predetermined phase control signals SYph and SMph.

The AC power control circuits 55Y and 55M respectively control the switching circuits SW of the respective AC power generators 52Y and 52M based on the amplitude control signals SYamp and SMamp, and the phase control signals SYph and SMph output from the high-voltage power control circuit 56. Since the amplitude VKpp of the AC voltage VKac is independent from the other three amplitudes VYpp, VMpp, and VCpp, the control unit 58 controls the high-voltage power control circuit 56 so that only the AC power generator 52K is controlled independently. The high-voltage power control circuit 56 outputs a predetermined amplitude control signal SKamp and a predetermined phase control signal SKph to the AC power control circuit 55K. The AC power control circuit 55K controls the switching circuit SW of the AC power generator 52K based on the amplitude control signal SKamp and the phase control signal SKph.

Figure 4:
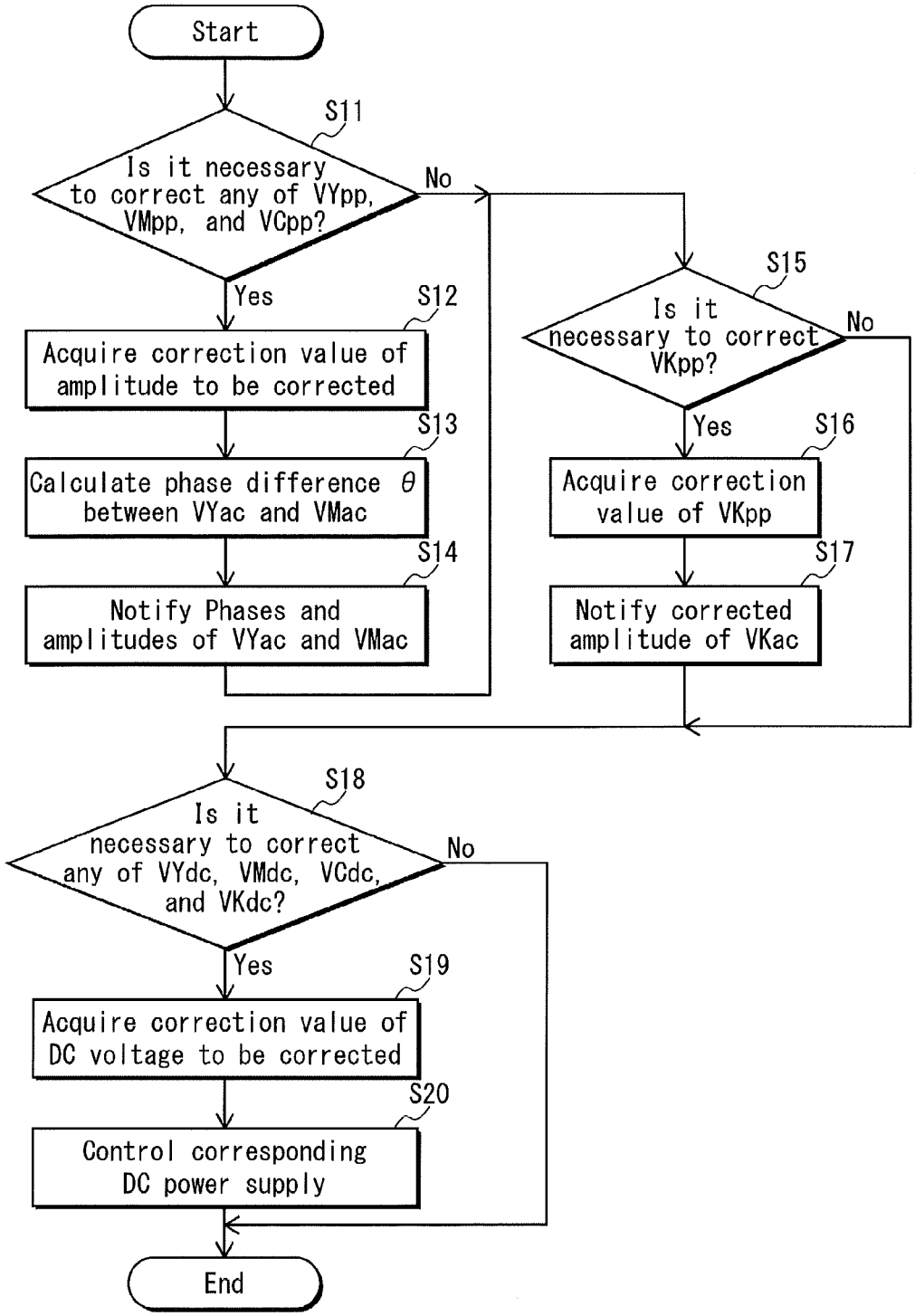
FIG. 4 is a flow chart showing steps of control to correct a composite voltage to be applied to a charging roller during printing.

FIG. 4 is a flow chart showing steps of the control to correct any of the composite voltages VYv, VMv, VCv, and VKv performed by the control unit 58 during color printing. The following describes the control to correct any of the composite voltages performed by the control unit 58, with reference to the flow chart of FIG. 4.

Each time the number of copies printed by each of the process units 10Y, 10M, 10C, and 10K reaches a predetermined value, the control unit 58 corrects the DC voltages VYdc, VMdc, VCdc, and VKdc respectively output from the DC power supplies 53Y, 53M, 53C, and 53K. That is to say, until the number of printed copies reaches the predetermined value, if it is unnecessary to correct any of the DC voltages VYdc, VMdc, VCdc, and VKdc based on the results of detection performed by the environmental sensor 61, the control unit 58 controls the DC power supplies 53Y, 53M, 53C, and 53K so that the DC voltages VYdc, VMdc, VCdc, and VKdc become respective reference DC voltage values corresponding to the number of printed copies.

Similarly, each time the number of copies printed by each of the process units 10Y, 10M, 10C, and 10K reaches a predetermined value, the amplitudes VYpp, VMpp, VCpp, and VKpp of the respective AC voltages VYac, VMac, VCac, and VKac are corrected. That is to say, until the number of printed copies reaches the predetermined value, if it is unnecessary to correct any of the amplitudes VYpp, VMpp, VCpp, and VKpp based on the results of detection performed by the environmental sensor 61, the control unit 58 performs control so that the amplitudes VYpp, VMpp, VCpp, and VKpp become respective reference amplitude values corresponding to the number of printed copies.

When the control to correct any of the composite voltages is started as shown in FIG. 4, the control unit 58 judges whether or not it is necessary to correct any of the amplitudes VYpp, VMpp, and VCpp of the respective AC voltages VYac, VMac, and VCac respectively included in the composite voltages VYv, VMv, and VCv, based on the temperature and humidity inside a printer detected by the environmental sensor 61 or the number of copies printed by each of the process units 10Y, 10M, 10C, and 10K (see step S11 in FIG. 4, hereinafter the same).

When it is unnecessary to correct any of the amplitudes VYpp, VMpp, and VCpp ("NO" in step S11), the processing proceeds to step S15 in which the control unit 58 judges whether or not it is necessary to correct the amplitude VKpp of the AC voltage VKac.

When it is necessary to correct any of the amplitudes VYpp, VMpp, and VCpp ("YES" in step S11), the control unit 58 acquires a correction value of the amplitude to be corrected from the table stored in the storage unit 58*a* (step S12).

When acquiring the correction value of the amplitude to be corrected, the control unit 58 calculates, based on the acquired correction value, the phase difference θ between the AC voltages VYac and VMac required to obtain the amplitude VCpp (step S13).

In this case, even if it is unnecessary to correct the amplitude VCpp, the phase difference θ between the AC voltages VYac and VMac is changed so that the amplitude VCpp is not changed by the corrected amplitudes VYpp and VMpp when one or both of the amplitudes VYpp and VMpp is/are corrected. When it is necessary to correct the amplitude VCpp, the phase difference θ between the AC voltages VYac and VMac is changed, irrespective of whether or not it is necessary to correct the amplitudes VYpp and VMpp.

When calculating the phase difference θ, the control unit 58 notifies the high-voltage power control circuit 56 of the phases of the respective AC voltages VYac and VMac, based on the calculated phase difference θ (step S14). Also in step S14, the control unit 58 notifies the high-voltage power control circuit 56 of the amplitudes VYpp and VMpp (the correction values acquired in step S11 when it is necessary to perform correction) of the respective AC voltages VYac and VMac. The processing then proceeds to step S15.

In step S15, the control unit 58 confirms whether or not it is necessary to correct the amplitude VKpp. When it is necessary to correct the amplitude VKpp ("YES" in step S15), the control unit 58 acquires the correction value of the amplitude VKpp from the table stored in the storage unit 58*a* (step S16) and notifies the high-voltage power control circuit 56 of the acquired correction value (step S17). The high-voltage power control circuit 56 outputs the amplitude control signal SKamp corresponding to the correction value of the amplitude VKpp to the AC power control circuit 55K. The processing then proceeds to step S18.

In the case where any of the amplitudes VYpp, VMpp, VCpp, and VKpp is corrected since the number of copies printed by each process unit reaches a predetermined value, the correction values acquired in steps S12 and S16 are each stored in the storage unit 58*a* as the reference amplitude values. Thereafter, until the number of copies printed by each of the process units 10Y, 10M, 10C, and 10K reaches a newly-set predetermined value, the high-voltage power control circuit 56 is controlled so that the amplitudes VYpp, VMpp, VCpp, and VKpp become the stored reference amplitude values when it is unnecessary to correct any of the amplitudes VYpp, VMpp, VCpp, and VKpp.

In step S18, the control unit 58 judges whether or not it is necessary to correct any of the DC voltages VYdc, VMdc, VCdc, and VKdc respectively included in the composite voltages VYv, VMv, VCv, and VKv, based on the temperature and humidity inside the printer detected by the environmental sensor 61 or the number of copies printed by each of the process units 10Y, 10M, 10C, and 10K. When it is necessary to correct any of the DC voltages VYdc, VMdc, VCdc, and VKdc, the control unit 58 acquires the correction value of the DC voltage to be corrected (step S19).

The control unit 58 then controls the DC power supply corresponding to the DC voltage to be corrected so that the acquired correction value of the DC voltage is output from the corresponding DC power supply (step S20).

In the case where any of the DC voltages VYdc, VMdc, VCdc, and VKdc is corrected since the number of copies printed by each process unit reaches a predetermined value, the correction values acquired in step S18 are stored in the storage unit 58*a* as the reference DC voltage values. Thereafter, until the number of copies printed by each of the process units 10Y, 10M, 10C, and 10K reaches a newly-set predetermined value, the high-voltage power control circuit 56 is controlled so that the DC voltages VYdc, VMdc, VCdc, and VKdc become the stored reference DC voltage values when it is unnecessary to correct any of the DC voltages VYdc, VMdc, VCdc, and VKdc.

The composite voltages VYv, VMv, VCv, and VKv thus generated are respectively applied to the charging rollers 12Y, 12M, 12C, and 12K. As a result, each of the photosensitive layers of the photoreceptor drums 11Y, 11M, 11C, and 11K are charged to have a predetermined potential.

In this case, since any of the composite voltages VYv, VMv, VCv, and VKv is corrected based on the number of copies printed by each of the process units 10Y, 10M, and 10K and the temperature and humidity inside the printer detected by the environmental sensor 61, the photosensitive layers of the photoreceptor drums 11Y, 11M, and 11K are almost uniformly charged to have an appropriate potential responding to degradation of the photosensitive layers, environmental changes and the like.

Furthermore, the AC voltage VCac included in the composite voltage VCv is generated from the AC voltages VYac and VMac respectively generated from the AC power generators 52Y and 52M. Therefore, compared to a case where AC voltages for Y, M, and C colors are generated by the respective AC power supplies for Y, M, and C colors, the charging power control device 50 is configurable to have a simple structure with a smaller number of components. As a result, the cost of manufacturing the charging power control device 50 is reduced, thereby leading to cost savings.

In the charging power control device 50 according to the present embodiment, the amount of the current flowing due to discharge caused between the charging rollers 12Y, 12M, and 12C, and the respective photoreceptor drums 11Y, 11M, and 11C is small (current of approximately 100 mA). For the above-mentioned reason, when the AC voltage VCac included in the composite voltage VCv to be applied to the charging roller 12C is generated from the AC voltages VYac and VMac respectively generated by the AC power generators 52Y and 52M, there is little risk that the composite voltages VYv and VMv respectively to be applied to the charging rollers 12Y and 12M would be lowered. As a result, it is possible to ensure stable application of the composite voltages VYv, VMv, and VCv of predetermined values to the respective charging rollers 12Y, 12M, and 12C.

<Modifications>

In the above-mentioned embodiment, description has been made of the composite voltages (field-production voltages) VYv, VMv, and VCv for causing discharge between the charging rollers 12Y, 12M, and 12C, and the respective photoreceptor drums 11Y, 11M, and 11C. The present invention, however, may not have the above-mentioned structure, and is applicable to composite voltages (field-production voltages) applied to produce electric fields between the developing rollers 14*a* of the respective developing devices 14Y, 14M, and 14C, and the respective photoreceptor drums 11Y, 11M, and 11C.

Furthermore, the composite voltages VYv, VMv, VCv, and VKv have been described to be corrected based on the changes in temperature and humidity. In a case where the change in temperature and humidity has little effect on a toner image formed on the photosensitive layer, however, each of the composite voltages VYv, VMv, VCv, and VKv may not be corrected.

Similarly, if the increase in the number of printed copies causes little degradation of the photosensitive layer, the composite voltages VYv, VMv, VCv, and VKv may not be corrected.

The present invention is not limited to the structure in which the capacitor (condenser) is used as the DC cut-off filter. Furthermore, the structure of each of the AC power generators 52Y, 52M, and 52K is not limited to the structure in which the AC voltage is generated by the switching circuit SW as described above, and may have another structure.

<Summary>

Since the image forming apparatus of the present invention generates third field-production voltage for causing the third AC electric field by superimposing a composite of the first field-production voltage generated by the first AC power supply and the second field-production voltage generated by the second AC power supply on the third DC voltage, an AC power supply for generating the third field-production voltage is unnecessary. With this structure, the structure of the power control device is simplified with a reduced number of components, thereby leading to cost savings.

It is preferred that the composite circuit include: a first DC cut-off filter configured to cut off a DC component of the first field-production voltage to obtain a first AC component; and a second DC cut-off filter configured to cut off a DC component of the second field-production voltage to obtain a second AC component, and apply the first AC component to the third voltage-applied member and apply the second AC component to the third photoreceptor, at least one of the first AC component and the second AC component being superimposed on the third DC voltage.

It is preferred that the third voltage-applied member be connected to an output side of the first DC cut-off filter, the third photoreceptor be connected to an output side of the second DC cut-off filter, and the third DC voltage be applied to one of the third voltage-applied member and the third photoreceptor.

It is preferred that each of the first DC cut-off filter and the second DC cut-off filter be a capacitor.

It is preferred that the image forming apparatus further comprise: a first DC power supply configured to generate the first DC voltage; a second DC power supply configured to generate the second DC voltage; a third DC power supply configured to generate the third DC voltage; and a DC control unit configured to control the first DC power supply, the second DC power supply, and the third DC power supply to adjust the first DC voltage, the second DC voltage, and the third DC voltage, respectively.

It is preferred that the first AC power supply include a first transformer including a first coil to which the first AC voltage is applied and a second coil to which the first DC voltage is applied, a high-voltage side output line of the second coil of the first transformer being connected to the first voltage-applied member, and the second AC power supply include a second transformer including a first coil to which the second AC voltage is applied and a second coil to which the second DC voltage is applied, a high-voltage side output line of the second coil of the second transformer being connected to the second voltage-applied member.

It is preferred that the first DC cut-off filter be connected to wiring branching from the high-voltage side output line of the second coil of the first transformer, and the second DC cut-off filter be connected to wiring branching from the high-voltage side output line of the second coil of the second transformer.

It is preferred that the image forming apparatus further comprise an AC control unit configured to control the first AC power supply and the second AC power supply to adjust at least one of an amplitude and a phase of the first AC voltage, and at least one of an amplitude and a phase of the second AC voltage, respectively.

It is preferred that the first AC power supply include a first AC power generator for generating the first AC voltage by DC power switching, and the second AC power supply include a second AC power generator for generating the second AC voltage by DC power switching.

It is preferred that the first, second, and third voltage-applied members be each charging rollers for charging the respective first, second, and third photoreceptors.

It is preferred that the first, second, and third voltage-applied members be each developing rollers for providing toner for the respective first, second, and third photoreceptors.

The present invention is useful, in an image forming apparatus including process units for forming toner images on respective three photoreceptors by an electrophotographic process, as technology to simplify the structure of a power control device for producing AC electric fields between the voltage-applied members and the respective photoreceptor drums included in the process units.

Although the present invention has been fully described by way of examples with reference to the accompanying drawings, it is to be noted that various changes and modifications will be apparent to those skilled in the art. Therefore, unless such changes and modifications depart from the scope of the present invention, they should be constructed as being included therein.

What is claimed is:

1. An image forming apparatus that forms a color image by overlaying, one on top of another, toner images formed on respective first, second, and third photoreceptors by an electrophotographic process, comprising:

a first voltage-applied member facing the first photoreceptor;

a second voltage-applied member facing the second photoreceptor;

a third voltage-applied member facing the third photoreceptor;

a first AC power supply configured to generate first AC voltage, and superimpose the first AC voltage on first DC voltage to generate first field-production voltage for causing a first AC electric field between the first voltage-applied member and the first photoreceptor;

a second AC power supply configured to generate second AC voltage having a same frequency as the first AC voltage, and superimpose the second AC voltage on second DC voltage to generate second field-production voltage for causing a second AC electric field between the second voltage-applied member and the second photoreceptor; and a composite circuit configured to superimpose a composite of the first field-production voltage and the second field-production voltage on third DC voltage, to generate third field-production voltage for causing a third AC electric field between the third voltage-applied member and the third photoreceptor.

2. The image forming apparatus of claim 1, wherein the composite circuit includes: a first DC cut-off filter configured to cut off a DC component of the first field-production voltage to obtain a first AC component; and a second DC cut-off filter configured to cut off a DC component of the second field-production voltage to obtain a second AC component, and applies the first AC component to the third voltage-applied member and applies the second AC component to the third photoreceptor, at least one of the first AC component and the second AC component being superimposed on the third DC voltage.

3. The image forming apparatus of claim 2, wherein the third voltage-applied member is connected to an output side of the first DC cut-off filter, the third photoreceptor is connected to an output side of the second DC cut-off filter, and the third DC voltage is applied to one of the third voltage-applied member and the third photoreceptor.

4. The image forming apparatus of claim 2, wherein each of the first DC cut-off filter and the second DC cut-off filter is a capacitor.

5. The image forming apparatus of claim 2, wherein the first AC power supply includes a first transformer including a first coil to which the first AC voltage is applied and a second coil to which the first DC voltage is applied, a high-voltage side output line of the second coil of the first transformer being connected to the first voltage-applied member, and the second AC power supply includes a second transformer including a first coil to which the second AC voltage is applied and a second coil to which the second DC voltage is applied, a high-voltage side output line of the second coil of the second transformer being connected to the second voltage-applied member.

6. The image forming apparatus of claim 5, wherein the first DC cut-off filter is connected to wiring branching from the high-voltage side output line of the second coil of the first transformer, and the second DC cut-off filter is connected to wiring branching from the high-voltage side output line of the second coil of the second transformer.

7. The image forming apparatus of claim 1, further comprising:

a first DC power supply configured to generate the first DC voltage;

a second DC power supply configured to generate the second DC voltage;

a third DC power supply configured to generate the third DC voltage; and a DC control unit configured to control the first DC power supply, the second DC power supply, and the third DC power supply to adjust the first DC voltage, the second DC voltage, and the third DC voltage, respectively.

8. The image forming apparatus of claim 1, further comprising an AC control unit configured to control the first AC power supply and the second AC power supply to adjust at least one of an amplitude and a phase of the first AC voltage, and at least one of an amplitude and a phase of the second AC voltage, respectively.

9. The image forming apparatus of claim 1, wherein the first AC power supply includes a first AC power generator for generating the first AC voltage by DC power switching, and the second AC power supply includes a second AC power generator for generating the second AC voltage by DC power switching.

10. The image forming apparatus of claim 1, wherein the first, second, and third voltage-applied members are each charging rollers for charging the respective first, second, and third photoreceptors.

11. The image forming apparatus of claim 1, wherein the first, second, and third voltage-applied members are each developing rollers for providing toner for the respective first, second, and third photoreceptors.

12. A power control device that causes a first AC electric field with respect to a first voltage-applied member, a second AC electric field with respect to a second voltage-applied member, and a third AC electric field with respect to a third voltage-applied member, comprising:

a first AC power supply configured to generate first AC voltage, and superimpose the first AC voltage on first DC voltage to generate first field-production voltage for causing the first AC electric field;

a second AC power supply configured to generate second AC voltage having a same frequency as the first AC voltage, and superimpose the second AC voltage on second DC voltage to generate second field-production voltage for causing the second AC electric field; and a composite circuit configured to superimpose a composite of the first field-production voltage and the second field-production voltage on third DC voltage, to generate third field-production voltage for causing the third AC electric field.

* * * * *